US008087981B2

(12) United States Patent
Hoskins

(10) Patent No.: US 8,087,981 B2
(45) Date of Patent: Jan. 3, 2012

(54) WEEP HOLE COVER

(76) Inventor: Kenneth Hoskins, Oxford, MS (US)

( * ) Notice: Subject to any disclaimer, the term of this patent is extended or adjusted under 35 U.S.C. 154(b) by 662 days.

(21) Appl. No.: 12/152,316

(22) Filed: May 14, 2008

(65) Prior Publication Data

US 2008/0305734 A1 Dec. 11, 2008

Related U.S. Application Data

(60) Provisional application No. 60/942,121, filed on Jun. 5, 2007.

(51) Int. Cl.
*F24F 7/00* (2006.01)

(52) U.S. Cl. ..... 454/275; 454/276; 454/271; 454/270

(58) Field of Classification Search ..... 454/275, 454/276, 283, 270, 271, 280
See application file for complete search history.

(56) References Cited

U.S. PATENT DOCUMENTS 3,257,929 A * 6/1966 Kortvely ..... 454/280
4,469,018 A * 9/1984 Taulman ..... 454/276
4,587,891 A * 5/1986 Kruse ..... 454/271
4,587,892 A * 5/1986 Witten et al. ..... 454/276
4,676,145 A 6/1987 Allred
5,444,947 A 8/1995 Miller
5,460,572 A 10/1995 Waltz et al.
6,044,594 A * 4/2000 Desselle ..... 52/101
6,176,048 B1 * 1/2001 Berger ..... 52/101
6,302,785 B1 10/2001 McKinney et al.
6,360,493 B1 * 3/2002 Torres, III ..... 52/101
6,817,942 B1 11/2004 Betz
7,823,339 B1 * 11/2010 Huber, Jr. ..... 52/101
2009/0019793 A1 * 1/2009 Huber, Jr. ..... 52/101

* cited by examiner

*Primary Examiner* — Steven B McAllister
*Assistant Examiner* — Brittany E Towns
(74) *Attorney, Agent, or Firm* — Maier & Maier, PLLC

(57) ABSTRACT

An apparatus for providing ventilation in a lower level of a building and for preventing mold and mildew from building up in an interior portion of such building while also preventing entrance of small unwanted animals. The apparatus comprises a frame member having each of a first predetermined shape and a first predetermined size and formed of a first predetermined material. A screen member is engageable with the frame member for attachment thereto, such screen member having each of a second predetermined shape and a second predetermined size and being formed of a second predetermined material. The apparatus is secured to the structure by one of masonry screws or is secured in new construction with bricks and brick mortar.

11 Claims, 2 Drawing Sheets

WEEP HOLE COVER

CROSS REFERENCE TO RELATED APPLICATIONS

This application is closely related to and claims benefit from U.S. Provisional Application Ser. No. 60/942,121 filed Jun. 5, 2007.

FIELD OF THE INVENTION

The present invention relates, in general, to a foundation vent, generally referred to as a weep hole, and, more particularly, the present invention relates to a weep hole cover that permits the base to breathe and yet keeps unwanted pests out.

BACKGROUND OF THE INVENTION

The foundation of a home is critical to the integrity of the structure. That's the reason why foundation ventilation is critical. Unventilated foundations are subject to built-up moisture that can eventually lead to costly damage.

During the construction phase of present day brick-veneer structures, gaps called weep holes are purposely built into the lower layers of bricks in order to allow the wall to drain and ventilate. The unfortunate drawback of weep holes is that they may allow pests free access to the interior of the walls. Weep hole covers were developed to eliminate weep holes as a door to animals and bugs.

There can be a problem in existing structures that do not have covers for weep holes since it is difficult to fit existing covers into holes in existing structures.

Thus, it would be advantageous if there were a simple and effective means of providing weep hole covers that would be applicable to new construction as well as in existing structures.

SUMMARY OF THE INVENTION

In a first aspect the present invention provides an apparatus for providing ventilation in a lower level of a building and for preventing mold and mildew from building up in an interior portion of such building while also preventing entrance of small unwanted animals. The apparatus comprises a frame member having each of a first predetermined shape and a first predetermined size and formed of a first predetermined material. A screen member is engageable with the frame member for attachment thereto, such screen member having each of a second predetermined shape and a second predetermined size and being formed of a second predetermined material. There is a means of securing the frame member with the screen member attached thereto to bricks near a base portion of such brick structures.

OBJECTS OF THE INVENTION

It is, therefore, one of the primary objects of the present invention to provide a weep hole cover that can be installed during construction of a new structure.

Another object of the present invention is to provide a weep hole cover that can be used in existing structures.

Still another object of the present invention is to provide a weep hole cover that will prevent small animals from entering the building.

Yet another object of the present invention is to provide a weep hole cover that has a metal screen.

In addition to the various objects and advantages of the invention which have been described in some specific detail above it should be noted that various other objects and advantages of the present invention will become more readily apparent to those persons who are skilled in the relevant art from the following more detailed description, particularly when such description is taken in conjunction with the appended claims.

Figure 1:
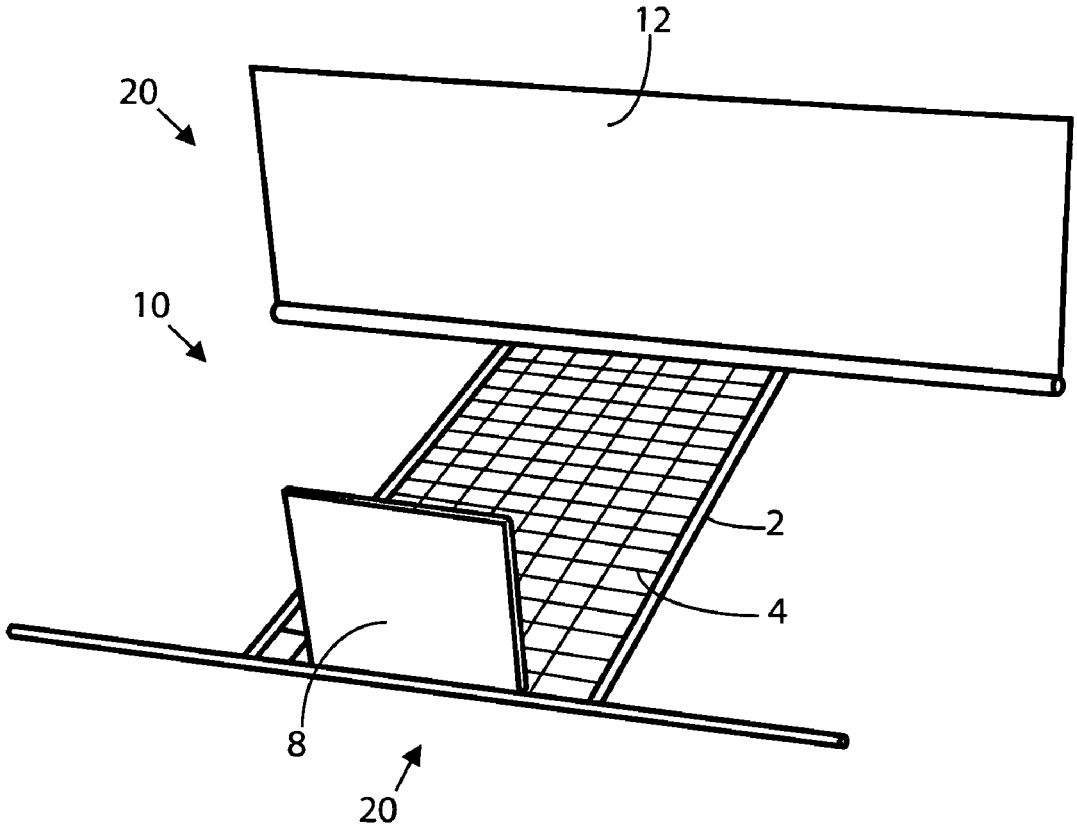
FIG. 1 is a perspective view of the apparatus for covering a weep hole in new construction according to an embodiment of the invention.
Figure 2:
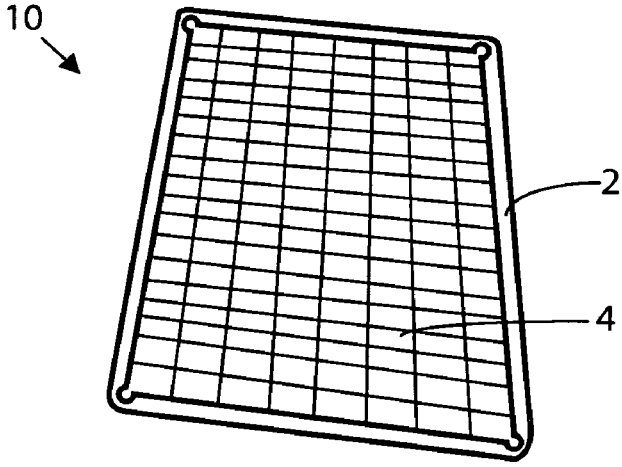
FIG. 2 is a is a top view of the screen member of the apparatus for use with existing buildings.
Figure 4:
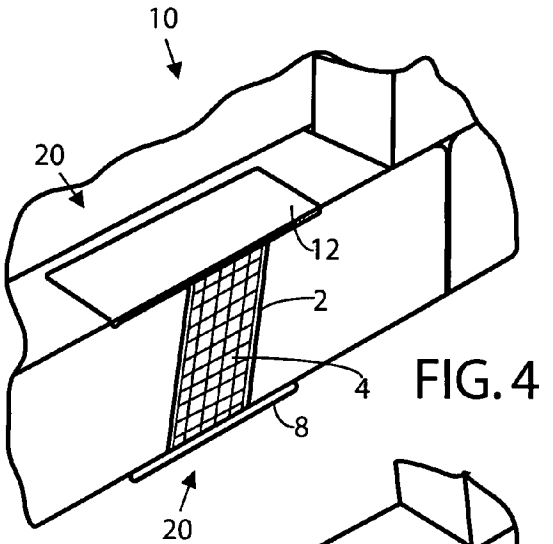
FIG. 4 is a perspective view of the apparatus shown in FIG. 1 set in place in new construction before the top layer of bricks are put in place.
Figure 5:
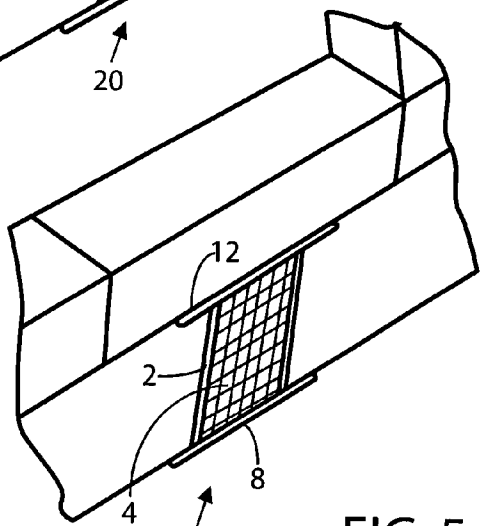
FIG. 5 is a front perspective view of the apparatus shown in FIG. 4 wherein the top brick is secured to the apparatus.
Figure 3:
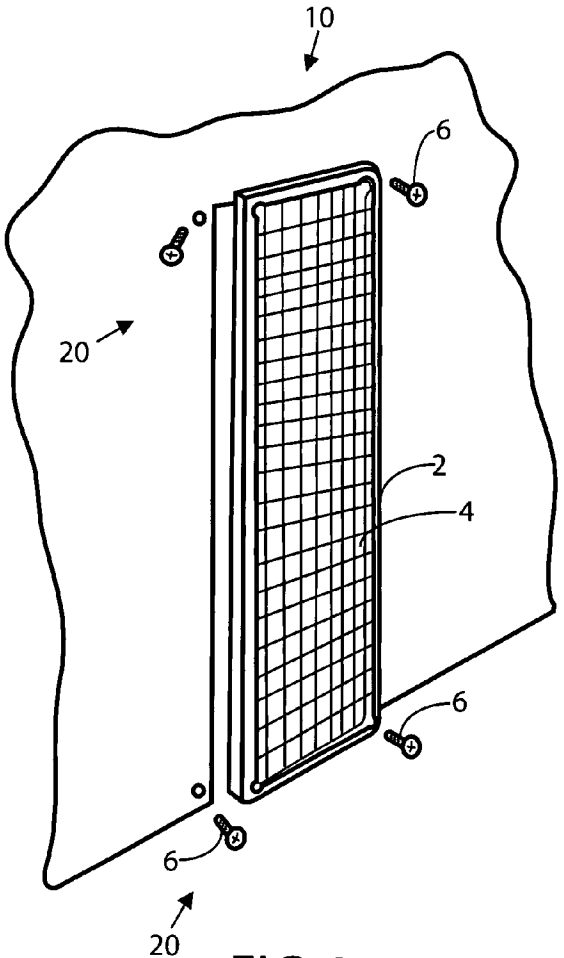
FIG. 3 is a front op perspective view of the screen member shown in FIG. 2 being attached to an existing building.

BRIEF DESCRIPTION OF THE PRESENTLY PREFERRED AND VARIOUS ALTERNATIVE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

In a first aspect the present invention provides an apparatus, generally designated 10, for providing ventilation in a lower level of a building and for preventing mold and mildew from building up in an interior portion of such building while also preventing entrance of small unwanted animals. The apparatus 10 comprises a frame member 2 having each of a first predetermined shape and a first predetermined size and formed of a first predetermined material. A screen member 4 is engageable with the frame member 2 for attachment thereto, such screen member 4 having each of a second predetermined shape and a second predetermined size and being formed of a second predetermined material. There is a means, generally designated 20, for securing the frame member 2 with the screen member 4 attached thereto to bricks near a base portion of such brick structures.

The securing means 20 includes one of masonry nails and masonry screws 6 engageable with such bricks near such base portion of an existing brick home. Such screws or nails engage the corners of the frame member 2 and further engage the bricks disposed on either side of the weep hole.

The securing means 20 for a brick house under construction includes a first substantially flat member disposed on a bottom portion of the frame member 2 for resting on one of a concrete pad and a brick member. The securing means 20 further includes a second substantially flat member 12 disposed on a top portion of the frame member 2 for engagement with another brick member from another row of bricks for holding the apparatus 10 in place. Such securing means 20 further includes brick mortar for securing the apparatus 10 with such another brick member.

The second substantially flat member 12 is substantially parallel to the first substantially flat member 8.

It is presently preferred that such screen member 4 is attached to the frame member by 4 molding the screen 4 to the frame member 2. It is also preferred that such first material and such second material are substantially similar materials. Such materials can be metal or hard plastic. It is further preferred that such material is metallic and even more preferably preferred that such material is metallic and even more preferably preferred that such metal is copper.

The first predetermined shape and the second predetermined shape are substantially rectangular. Such first predetermined size is between about 1⅞ inches and about 3¼ inches high and between about ⅞ and about 1⅛ inches wide and the second predetermined size of the screen member is substantially identical to the first predetermined size.

Thus, the present invention was designed to cover small openings (weep hole) left near the base of brick homes built on concrete foundations. The present invention provides two different designs. While the designs are very similar there are several differences depending on whether the weep hole to be covered in is new construction or in an existing building. The invention that is used for new construction has two substantially flat parallel plate members. A first plate member which is the base for the screen member which is used to cover the opening sits on the floor of the structure while the second plate member fits on the top of the screen member and also sits on top of an existing brick and is held in place with another course of brick and further secured with brick mortar.

The unit used for existing buildings has the screen member but does not have the plate members. In this case the screen is positioned over the weep hole and secured to the brick through the use of masonry screws or nails which engage the four corners of the screen member with holes in bricks and held in place with the masonry screws. In either case the screen mesh is small enough to prevent small animals from entering the building.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. An apparatus for providing ventilation in a lower level of a building and for preventing mold and mildew from building up in an interior portion of such building while also preventing entrance of small unwanted animals, said apparatus comprising:

(a) a frame member having each of a first predetermined shape and a first predetermined size, the first predetermined shape and first predetermined size being larger than a ventilation hole to be covered a top portion and a bottom portion comprising arms extending outwardly from the top and bottom portions of the frame, and formed of a first predetermined material;

(b) a screen member engageable with said frame member for attachment thereto, said screen member having each of a second predetermined shape and a second predetermined size and formed of a second predetermined material, the second predetermined shape and the second predetermined size being larger than the ventilation hole to be covered, (c) a substantially flat top flange member disposed along a top portion of said frame member and said screen member, said top flange member having an interior surface and exterior surface wherein the interior surface being capable of engaging with a top surface of brick member, and (d) a substantially flat bottom flange member disposed along a bottom portion of said frame member and said screen member, said bottom flange member having an interior surface and exterior surface wherein the exterior surface being capable of resting with another brick member from another row of bricks and sized smaller than the substantially flat top flange.

2. The apparatus, according to claim 1, further comprising brick mortar for securing said apparatus with another brick member.

3. The apparatus, according to claim 1, wherein said substantially flat bottom flange member is substantially parallel to said substantially flat top flange member.

4. The apparatus, according to claim 1, wherein said screen member is attached to said frame member by molding said screen to said frame member.

5. The apparatus, according to claim 1, wherein said first material and said second material are substantially similar materials.

6. The apparatus, according to claim 1, wherein said first material and said second material are one of metal and plastic.

7. The apparatus, according to claim 6, wherein said first and said second material are metal.

8. The apparatus, according to claim 7, wherein said metal is copper.

9. The apparatus, according to claim 1, wherein said first predetermined shape and said second predetermined shape are substantially rectangular.

10. The apparatus, according to claim 1, wherein said first predetermined size is between about 1⅞ inches and about 3¼ inches high and between about ⅞ and about 1⅛ inches wide.

11. The apparatus, according to claim 9, wherein said second predetermined size of said screen member is substantially identical to said first predetermined size.

* * * * *